US008220700B2

(12) United States Patent
Myers et al.

(10) Patent No.: US 8,220,700 B2
(45) Date of Patent: Jul. 17, 2012

(54) EASY-OPENING PAPER TOWEL PRODUCT

(75) Inventors: Nancy Jo Myers, Dale, WI (US); Timothy Scott Burnham, Appleton, WI (US); Darcey Ellen McCormick, Appleton, WI (US); Andrew David Zillges, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 361 days.

(21) Appl. No.: 12/615,360

(22) Filed: Nov. 10, 2009

(65) Prior Publication Data

US 2011/0111158 A1 May 12, 2011

(51) Int. Cl.

| | |
|---|---|
| ***B65D 65/26*** | (2006.01) |
| ***B65D 33/00*** | (2006.01) |
| ***B65D 30/08*** | (2006.01) |
| ***B65D 85/00*** | (2006.01) |

(52) U.S. Cl. ..... 229/87.05; 383/201; 383/109; 206/410

(58) Field of Classification Search ..... 383/200, 383/201, 207–209, 109; 206/410, 389; 229/87.05
See application file for complete search history.

(56) References Cited

U.S. PATENT DOCUMENTS

| | | | | | |
|---|---|---|---|---|---|
| 3,302,856 | A | * | 2/1967 | Thompson et al. | 229/123.2 |
| 3,403,779 | A | * | 10/1968 | Becker et al. | 206/432 |
| 3,403,840 | A | * | 10/1968 | Mathes | 229/203 |
| 3,460,671 | A | | 8/1969 | Harm | |
| 4,558,785 | A | | 12/1985 | Gordon | |
| 4,726,473 | A | * | 2/1988 | Sato et al. | 229/87.05 |
| 4,765,474 | A | | 8/1988 | James | |
| 4,860,893 | A | * | 8/1989 | Kaufman | 206/390 |
| 5,423,423 | A | * | 6/1995 | Sato et al. | 206/387.1 |
| 6,006,907 | A | * | 12/1999 | Sato et al. | 206/387.1 |
| 7,470,062 | B2 | | 12/2008 | Moteki et al. | |
| 2006/0027637 | A1 | | 2/2006 | Conrad et al. | |

FOREIGN PATENT DOCUMENTS

| | | | | |
|---|---|---|---|---|
| EP | 0 372 886 | A2 | | 6/1990 |
| EP | 0 454 541 | A1 | | 10/1991 |
| EP | 0 590 708 | A1 | | 4/1994 |
| EP | 0 779 222 | A1 | | 6/1997 |
| EP | 1 153 852 | A2 | | 11/2001 |
| EP | 1 375 378 | A2 | | 1/2004 |
| EP | 1 405 802 | A1 | | 4/2004 |
| EP | 2 017 194 | A1 | | 1/2009 |
| EP | 2 030 911 | A1 | | 3/2009 |
| FR | 2 658 786 | A1 | | 8/1991 |
| JP | 09-048471 | A | | 2/1997 |
| JP | 2000109573 | A | * | 4/2000 |
| WO | WO 00/27715 | A1 | | 5/2000 |
| WO | WO 2006/050748 | A1 | | 5/2006 |
| WO | WO 2008/104444 | A1 | | 9/2008 |
| WO | WO 2009/013164 | A1 | | 1/2009 |
| WO | WO 2009/013165 | A1 | | 1/2009 |

* cited by examiner

*Primary Examiner* — Jes F Pascua
(74) *Attorney, Agent, or Firm* — Michael J. Sullivan

(57) ABSTRACT

A product, such as a roll of paper toweling, is wrapped in a polymeric film wrapper having a high degree of molecular orientation. The wrapper is provided with a small perforated starter tab, which a user can depress with their fingers or thumb to break the perforations. Upon breaking the perforations, the user can grasp the tab of the wrapper and thereafter open the package by pulling on the wrapper in the same direction as the molecular orientation direction of the wrapper. The high degree of molecular orientation allows the package to be cleanly torn open with very little effort.

14 Claims, 4 Drawing Sheets

EASY-OPENING PAPER TOWEL PRODUCT

Single rolls of paper towels are generally wrapped in a poly package which is folded and sealed at both ends of the roll. In order to open the package, the consumer generally punctures an end of the package with their thumb, scissors, knives etc., usually by pressing inwardly where the opening in the cardboard core of the roll is located, and tears off the wrapper away from the towel roll. Because the ends of the roll have multiple layers of poly folded upon each other, it is often not easy to puncture the wrapper and get the tear started. Also, once the tear is started, the resulting opening in the package is unpredictable and ragged.

Hence there is a need for an easy-opening paper towel product that enables the consumer to simply and reliably open the wrapper with their hands and remove the paper towel roll from the package.

SUMMARY OF THE INVENTION

In one aspect, the invention resides in a product wrapped in a polymeric film wrapper having a molecular orientation direction, said wrapper having a starter tab comprising a line of weakness, such as a line of perforations, defining a two-dimensional open-ended shape having a first side and an opposing second side, wherein the first and second sides of the starter tab are parallel or substantially parallel to the molecular orientation direction of the film wrapper. With this arrangement, a user can depress the starter tab and break the line of weakness, thereby enabling the user to grasp the wrapper and open the package by pulling on the wrapper in the molecular orientation direction of the wrapper. Surprisingly, the wrapper easily tears without the aid of additional lines of perforations or scoring of the film. The resulting torn edges of the film wrapper are surprisingly "clean" (hereinafter defined) in that they do not exhibit webbing, stretching or other ragged characteristics. Instead, the clean tears of the products of this invention appear to an ordinary observer to have been cut with a scissors or a razor blade. Particularly suitable products include individually wrapped tissue products, such as rolls of bath tissue and paper towels, or any product comprising a plurality of individual products, such as bundle packs of bath tissue, paper towels, table napkins, facial tissue cartons and the like. In order to break the line of weakness of the starter tab by depressing the starter tab, it is advantageous that the underlying product or product arrangement provide sufficient "give" or low compression resistance. For individually-wrapped products such as paper towel rolls, for example, the product inherently has sufficiently low compression resistance to easily enable a user to break the line of weakness of the starter tab with the tip of one's finger or thumb. For packages containing multiple individual products, the portions of the wrapper that overlay the void spaces in between individual products of the package can provide ideal locations for a starter tab.

In another aspect, the invention resides in a paper towel product comprising: (a) a roll of paper toweling, said roll having two ends and a central axis; (b) a polymeric film wrapper wrapped around the roll of paper toweling, thereby forming a package having two ends and a continuous sidewall therebetween, said polymeric film wrapper having a molecular orientation direction, which preferably is parallel or substantially parallel to the central axis of the roll; and (c) said package having a starter tab in the sidewall of the package, whereby a user can grasp the wrapper by depressing the starter tab and breaking the line of weakness, and thereafter open the package by pulling the wrapper in the molecular orientation direction of the wrapper to cleanly tear the wrapper.

The phenomenon of molecular orientation in polymeric films is well known to those in the packaging arts. Molecular orientation is created by machine direction extrusion and stretching of the films during manufacturing. Blown films generally exhibit the greatest degree of directional molecular orientation, although other films, such as cast films, also exhibit some degree of directional molecular orientation. The direction of the molecular orientation of a film sample can be determined by a number of ways known to those skilled in the film art. A particularly useful test method is the well known Elmendorf Tear Strength test (described below), which measures the Tear Strength of a film in a predetermined direction. For purposes herein, the molecular orientation direction of a film is the direction in which the Tear Strength of the film is the lowest, which coincides with the machine direction (MD) of the film. Conversely, the direction of the film in which the Tear Strength is the highest coincides with the cross-machine direction (CD) of the film. Highly-oriented films particularly suitable for purposes of this invention have an MD Tear Strength/CD Tear Strength ratio of about 0.10 or less, more specifically about 0.05 or less, more specifically about 0.03 or less, more specifically about 0.02 or less. A particularly suitably oriented film can have an MD Tear Strength/CD Tear Strength ratio of from about 0.01 to about 0.05.

A wide variety of films are suitable for purposes of this invention, provided they exhibit the necessary molecular orientation and resulting clean tear characteristics. For example, the films can be blown films, cast films or film laminations. The films can be mono-layer films, which can include a single polymer, blends of single polymers of differing molecular weights or other properties, or blends of different polymers. The films can also be multi-layered films, which can include layers of different polymers or polymer blends or layers of a single polymer or polymer blends of differing characteristics. For other packaging reasons, multi-layered films may be particularly advantageous because they can provide a number of different or balanced properties that may be desirable or necessary for certain packaging applications. Specifically, for example, multi-layered films can have outer layers (skin layers) that provide sealing characteristics, visual characteristics, flexibility or softness, while the center or core layer(s) can provide strength, stiffness and/or greater molecular orientation to provide the film with the desired overall Tear Strength. More particularly, high density polyethylene (HDPE), which generally comprises longer polymer chains and exhibits greater molecular orientation than low density polyethylene (LDPE), can be used as the core layer material while LDPE can be used for the skin layers. For such composite multi-layered films, the proper balance of HDPE and LDPE must be determined in order for the film to exhibit the appropriate overall Tear Strength. In general, an HDPE blown film may have a Tear Strength of only about 1 percent or less of that for an equivalent basis weight LDPE blown film. By way of example, it was found that a three-layered film having an average composition of 20% LDPE/60% HDPE/20% LDPE (on a weight percent basis), did not consistently exhibit a sufficiently low Tear Strength for purposes of this invention. Specifically, it was found that the 20/60/20 film provided suitably clean tears about 70 percent of the time, but failed to provide acceptably clean tears about 30 percent of the time. On the other hand, increasing the HDPE core amount to 70%, providing a 15% LDPE/70% HDPE/15% LDPE layered film lowered the overall Tear Strength sufficiently to reliably provide clean tears all of the time. In this regard, it should be noted that commercially available films may have a considerable amount of variation in the Tear Strengths. Therefore it is necessary to provide a film composition that reliably produces clean tears all of the time for a commercially acceptable product.

While high density polyethylene is particularly useful for purposes of this invention, other polymers can also exhibit sufficient molecular orientation to be useful for purposes of this invention. Such polymers include polyester, nylon, polypropylene and blends of these polymers. A suitable commercially available molecularly-oriented polymeric film is manufactured by Bemis Company, Inc., Neenah, Wis. The Tear Strength in the direction of molecular orientation of the film wrappers of this invention can advantageously be about 60 grams-force or less, more specifically from about 1 to about 60 grams-force, more specifically from about 1 to about 50 grams-force, more specifically from about 1 to about 40 grams-force, more specifically from about 1 to about 30 grams-force, and still more specifically from about 20 to about 40 grams-force. In contrast, the Tear Strength orthogonal to the directional of molecular orientation (in the cross-machine direction of the film wrapper) can be about 1000 grams-force or greater.

It will be appreciated that the Tear Strength can be dependent upon the thickness or caliper of the film. Hence thicker films will generally have higher Tear Strengths than comparable thinner films. Taking the thickness of the film into account, where thickness is measured in "mils" (thousandths of an inch), the ratio of the Tear Strength in the direction of molecular orientation of the film divided by the film thickness can be 60 grams-force or less per mil, more specifically from about 1 to about 60 grams-force per mil, more specifically from about 1 to about 50 grams-force per mil, more specifically from about 1 to about 40 grams-force per mil, more specifically from about 1 to about 30 grams-force per mil, and still more specifically from about 20 to about 40 grams-force per mil.

The Geometric Mean Tensile Strength (hereinafter defined) of the film wrappers useful for purposes of this invention can be any strength suitable for the purpose of wrapping products, but typically, without limitation, can be from about 1000 to about 2000 grams per one inch of sample width.

The MD stretch of the film wrappers suitable for purposes of this invention typically, without limitation, can be from about 200 to about 500 percent. The CD stretch typically, without limitation, can be from about 600 to about 800 percent.

The thickness or caliper of the film wrappers suitable for purposes of this invention can be any thickness suitable for wrapping products, but typically, without limitation, can be from about 0.02 to about 0.05 millimeters (mm), for example.

The starter tab can be any shape and size that can easily be grasped by a user of the product in order to initiate tearing out a strip from the wrapper. If the line of weakness is created by perforations, the perforations can be imparted to the film wrapper by any suitable means well-known to those familiar with the packaging arts, such as die cutting, laser perforating, and the like. For purposes herein, the line of weakness includes spaced-apart openings in the film or otherwise weakened areas in the film, such as by scored segments of the film formed without completely cutting through the sheet, or combinations thereof. In addition, the line of weakness forming the starter tab can be a continuous scored line. All that is required is that the film wrapper of the starter tab can be easily punctured by a user in order to initiate a tear. By way of example, without limitation, a suitable line of weakness is a line of perforations having perforations of about 3/16 inch long spaced apart from each other by non-perforated (land) areas of about 1/16 inch long. One of ordinary skill in the art will easily determine a suitable perforation pattern depending upon the nature of the product and the strength and stretch characteristics of the film wrapper being used. Advantageously, the length of the line of weakness defining the starter tab can be from about 1 to about 6 inches in length, more specifically from about 2 to about 6 inches, and still more specifically from about 2 to about 5 inches, depending upon the shape and desired size of the starter tab.

Suitable starter tab shapes particularly include open-ended two-dimensional shapes, such as a semi-circle or shapes resembling three sides of a rectangle, two sides of a triangle, three sides of a trapezoid, and the like. The open-ended shapes can be regular or irregular in shape. Such open-ended starter tabs become part of the strip that is torn from the wrapper when the package is opened. It is highly desirable that the line of weakness, such as a line of perforations, forming the opposing sides of the open-ended starter tab be parallel, or at least substantially parallel, to the direction of molecular orientation in order to most easily initiate the tear to open the package. For purposes herein, "substantially parallel" means that the angle between the direction in question, such as the lines of perforation of the sides of the starter tab, and the point of reference, such as the molecular orientation direction, is from 0 to about ±45 degrees, more specifically from 0 to about ±30 degrees, more specifically from 0 to about ±20 degrees, more specifically from 0 to about ±10 degrees, and still more specifically from 0 to about ±5 degrees. By way of example, the starter tabs illustrated in FIGS. 5B-5E herein have straight sides, so that their angle relative to the molecular orientation direction is easily measured. However, if the lines of weakness on the sides of the starter tab are curved, such as those illustrated in FIG. 5A, the angle of the line of weakness for purposes herein is measured using the tangent to the curve at the end point, such as the last perforation, in the curved line of weakness. While open-ended starter tab shapes are particularly advantageous because of their simplicity of operation, starter tabs that are completely removed from the package to create a distinct hole in the wrapper prior to tearing open the package are also within the scope of this invention, although initiating the tears can be more difficult for the user. Such starter tab shapes include oval, circular, square, triangular and the like.

For individually-wrapped roll products, such as rolls of paper towels, the molecular orientation direction of the wrapper is advantageously parallel or substantially parallel to the central axis of the roll. The closer the angle is to "0" relative to the central axis of the roll, the easier it is for the user to grasp the roll with one hand, such as grasping the top end of the roll, and pull the starter tab in a generally downward direction. While it would be possible, and within the scope of this invention, to have the molecular orientation direction of the wrapper parallel or substantially parallel to the circumferential direction of the roll, this arrangement might make it awkward for the user to hold and open the package, as it might require the user to change his/her grip on the roll several times while pulling the starter tab around the circumference of the package. Similarly, the molecular orientation direction of the wrapper relative to the axis of the roll can be about 45°.

Test Methods

For purposes herein, the "Tear Strength" of a film in a given direction is measured in accordance with the Elmendorf Tear Test (ASTM Test Method D1922) using a 40 gram pendulum.

The Tear Strength is reported as an average value, expressed in grams-force, for a representative number of samples, such as five or more.

For purposes herein, a "clean" tear is a tear which appears to the casual observer to be cut with a scissors or a razor blade. Quantitatively, the size of any irregularities or protrusions along the edge of the clean tear, as measured in the direction orthogonal to the direction of the tear, will be about 5 millimeters or less, more specifically about 4 millimeters or less, more specifically about 3 millimeters or less, more specifically about 2 millimeters or less, and still more specifically from about 0.01 to about 2 millimeters.

For purposes herein, the "Geometric Mean Tensile Strength" of a film is the square root of the product of the machine direction tensile strength multiplied by the cross-machine direction tensile strength. The "machine direction (MD) tensile strength" is the peak load per 1 inch (25.4 mm) of sample width when a sample is pulled to rupture in the machine direction. Similarly, the "cross-machine direction (CD) tensile strength" is the peak load per 1 inch (25.4 mm) of sample width when a sample is pulled to rupture in the cross-machine direction. The "stretch" is the percent elongation of the sample at the point of rupture during tensile testing.

Samples for tensile strength testing are prepared by cutting a 1 inch (25.4 mm) wide by 5 inches (127 mm) long film strip in the selected orientation (MD or CD) using a JDC Precision Sample Cutter (Thwing-Albert Instrument Company, Philadelphia, Pa., Model No. JDC 1-10, Serial No. J562). The instrument used for measuring tensile strengths is an MTS Systems 1G Constant-Rate-of Extension Tensile Tester. The data acquisition software is MTS TestWorks® 4 (MTS Systems Corp., Eden Prairie, Minn.). The load cell is selected from either a 50 Newton or 100 Newton maximum (S-Beam TEDS ID Load Cell), depending on the strength of the sample being tested, such that the majority of peak load values fall between 10-90% of the load cell's full scale value. The gauge length between jaws is 2±0.12 inches (51±3 mm). The jaws are operated using pneumatic-action and are rubber coated. The minimum back grip face width is 1.5 inches (38.1 mm), and the approximate height of a jaw is 0.5 inches (12.7 mm). The line contact face (also called the clamping face), which holds the poly in place, is a round horizontal rod at least 1 inch (25.4 mm) wide by 0.25 inch (6 mm). The crosshead speed is 20±0.4 inches/min (508±10 mm/min), and the break sensitivity is set at 65%. The data is recorded at 100 hz. The sample is placed in the jaws of the instrument, centered both vertically and horizontally. The test is then started and ends when the specimen breaks. The peak load is recorded as the "MD tensile strength" or the "CD tensile strength" of the specimen. At least five (5) representative specimens are tested for each film sample and the arithmetic average of all individual specimen tests is the MD or CD tensile strength for the film.

DETAILED DESCRIPTION OF THE DRAWINGS

Referring to the various Figures, the invention will be described in greater detail. The use of like reference numbers in different Figures is intended to identify like features.

Figure 1:
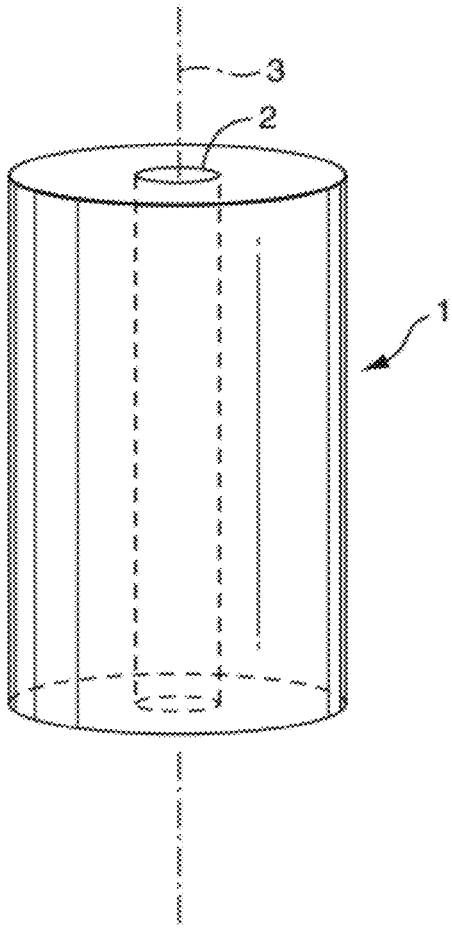
FIG. 1 is a schematic perspective view of a typical roll of paper toweling.

FIG. 1 illustrates a typical roll of paper toweling 1, which comprises a wound length of paper, most commonly comprising spaced-apart transverse lines of perforations which define individual "sheets" for removal from the roll by the user. As shown, the roll of paper toweling can include an optional core 2, around which the paper toweling is wound. For purposes of this invention, the presence of a core is not relevant, and coreless rolls can also be used. Also shown in FIG. 1 is the central axis 3 of the roll, which defines the axial direction.

Figure 2:
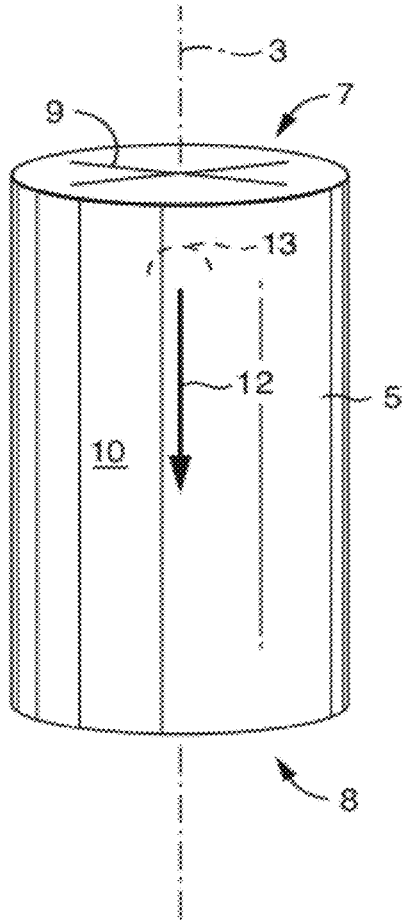
FIG. 2 is a schematic perspective view of product of this invention, illustrating the perforated starter tab.

FIG. 2 is a schematic perspective view of one embodiment of a product of this invention, in which a roll of paper toweling is packaged in a wrapper 5 of molecularly-oriented polymeric film. The product has two ends, which for purposes herein can be designated as a top end 7 and a bottom end 8 as shown. During packaging, the polymeric film wrapper is typically folded upon itself at both ends of the package as shown by a plurality of fold lines 9, while the sidewall 10 of the package is substantially free of wrinkles and folds. The molecular orientation direction of the polymeric film wrapper is represented by arrow 12 which, in the embodiment illustrated in FIG. 2, is parallel to the central axis of the roll. Also shown is a perforated starter tab 13, which is located near the top end of the package.

For purposes herein, the starter tab is advantageously located in the sidewall from about 0.1 to about 5 inches from the top end of the package, more specifically from about 0.5 to about 4 inches, more specifically from about 0.5 to about 3 inches, more specifically from about 0.5 to about 2 inches, and still more specifically from about 1 to about 2 inches from the top end of the package. The location of the starter tab should be sufficiently far away from the top end of the package to enable the user to grasp one end of the package and still easily locate and access the starter tab. At the same time, the starter tab must be sufficiently close to the top end so that the opening in the package created by tearing is sufficiently large to allow easy withdrawal of the product from the wrapper.

Figure 3:
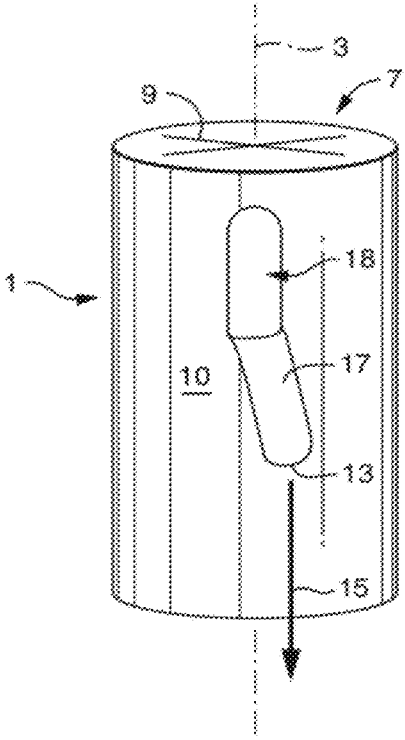
FIG. 3 is a schematic perspective view of the product of FIG. 2 in a partially-opened position.

FIG. 3 is a schematic view of the product of FIG. 2 in a partially-opened condition, illustrating how the product is opened. To reach this condition, the user presses their finger or thumb into the package at the location of the perforated starter tab 13. In so doing, the line of perforations is broken, allowing the user to grasp the starter tab or the film wrapper. The user then simply pulls down on the film wrapper or starter tab (in the direction of arrow 15), creating a pull strip 17, the removal of which creates an elongated opening 18 in the package.

Figure 4:
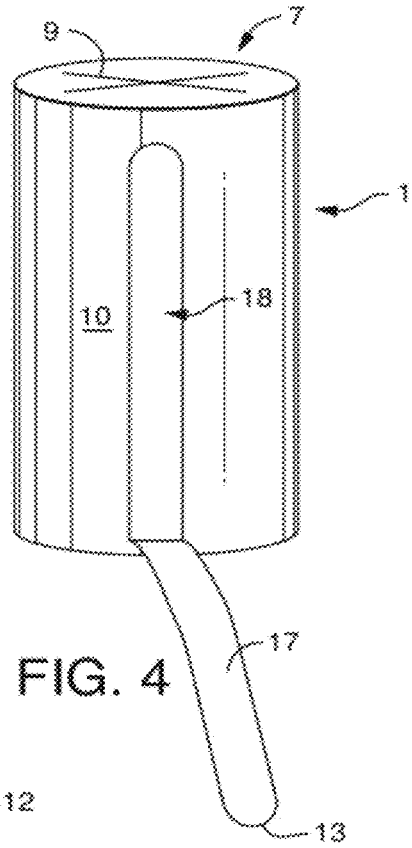
FIG. 4 is a schematic perspective view of the product of FIG. 2 in a fully-opened position.

FIG. 4 is a schematic view of the product of FIG. 2 in a fully-opened condition, where the resulting opening 18 extends substantially the length of the package. The length and width of the opening are such that the opening is of sufficient size to enable the user to easily reach into the package to grasp and remove the roll of paper toweling from the package. In this regard, the width of the starter tab and the opening can be from about 0.25 to about 3 inches, more specifically from about 0.5 to about 2 inches, and still more specifically about 1 inch. The length of the resulting opening, depending upon the length of the package, can suitably be from about 8 to about 10 inches for a typical roll of paper toweling. As previously stated, the edges of the opening are surprisingly crisp and clean due to the high degree of molecular orientation within the film wrapper. At the same time, removal of the pull strip is surprisingly effortless, as measured by the low Tear Strength values.

Figure 5A:
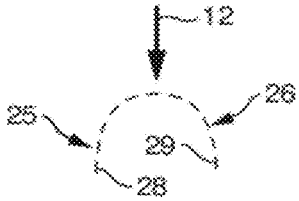
FIG. 5 is a schematic illustration of several starter tab shapes suitable for purposes of this invention.
Figure 5B:
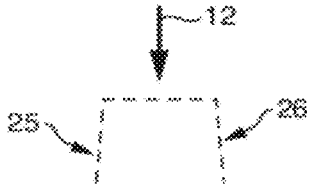
Figure 5C:
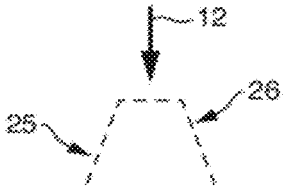
Figure 5D:
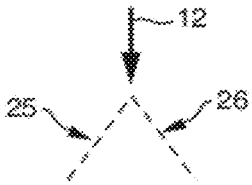
Figure 5E:
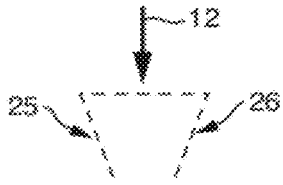

FIGS. 5A-5E illustrate several suitable starter tab shapes, which in each case are defined by a line of perforations. All of these shapes are two-dimensional shapes and are what is referred to herein as being "open-ended", meaning that the non-perforated portion (the open end) becomes part of the pull strip. FIG. 5A is semi-circular, FIG. 5B is rectangular, FIG. 5C is trapezoidal, FIG. 5D is triangular and FIG. 5E is trapezoidal. The particular shape of the starter tab is not critical, provided it enables the user to grasp, pull and tear the wrapper to open the package. Similarly, the length and spacing of the individual perforations can be any combination that achieves the intended purpose. As previously mentioned, it is highly desirable that the first side 25 of the starter tab and the opposing second side 26 of the starter tab be parallel or substantially parallel with the direction of molecular orientation 12. This makes the initiation of the tear easier for the user since the line of perforations or line of weakness on each side of the starter tab has effectively already initiated the tear. For curved lines of perforation or lines of weakness, as previously mentioned, the angle of the line of perforations for purposes herein is determined using the tangent to the curve at the point of the last perforation in the curved line of perforations. In FIG. 5A, the ends of the line of weakness, which are the last perforations at each end of the line of perforations, are designated by reference numbers 28 and 29. The intersection of the molecular orientation direction 12 and the tangent to the curve at points 28 and 29 would form the angle of the line of perforations for purposes herein. Advantageously, the angle is zero or within a few degrees of zero, such as about 5 degrees or less. It should be noted that the angle of the line of perforations can be the same or different for each side. For the embodiment of FIG. 5A, it can be advantageous to further extend the two sides of the starter tab in the direction of molecular orientation in order to further ensure the tear is initiated in the proper direction. By way of example, sides 25 and 26 of FIG. 5A can have a length in the molecular orientation direction of about 1 or 2 inches.

Figure 6A:
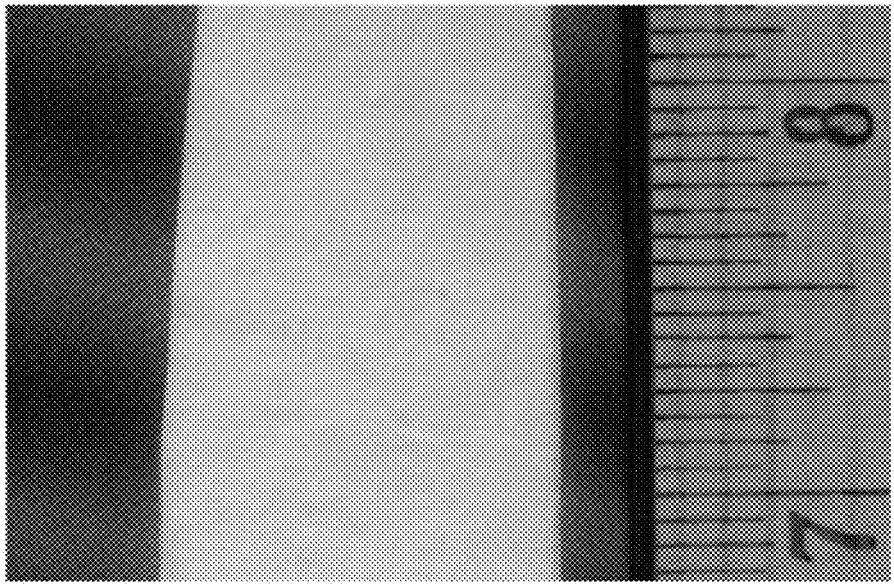
FIG. 6 includes photographs of examples of the clean tears in the film wrapper obtained in accordance with this invention.
Figure 6B:
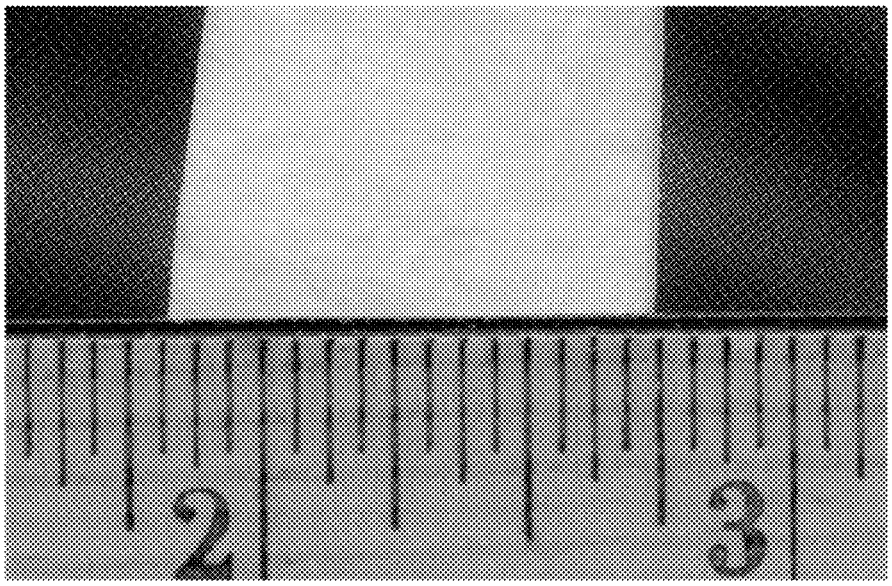
Figure 6C:
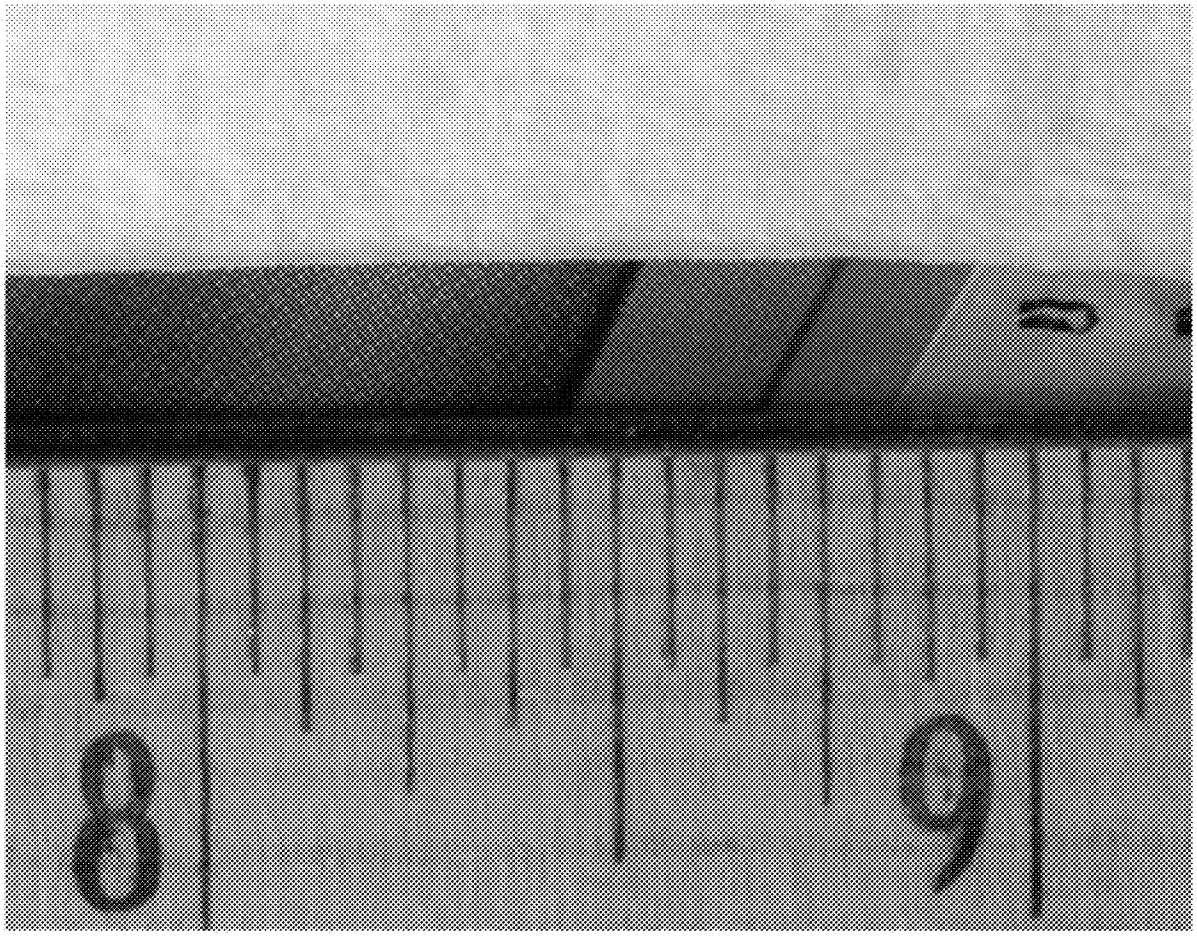

FIGS. 6A, 6B and 6C are photographs of clean tears in prototypes of products of this invention. A ruler is included in the photographs to illustrate how clean the edges of the tears can be. In FIG. 6A, the light area is the exposed roll of paper toweling within the package after the pull strip has been removed. The dark areas on either side of the exposed paper toweling is the poly film wrapper. In this photograph, the ruler is generally parallel to the direction of the tears. It should be noted that the tear lines in the poly wrapper on opposite sides of the pull strip are not perfectly parallel. This is common and apparently due to variations in the direction of molecular orientation in the film. Nevertheless, the tears are very clean.

FIG. 6B is similar to that of FIG. 6A, except the ruler in the photograph has been positioned perpendicular to the tear line direction.

FIG. 6C is similar to that of FIG. 6A, but showing only one opened edge of the poly wrapper and having slightly greater magnification. As can be seen along the edge of the poly wrapper in the vicinity of the "9" on the ruler, there is some slight irregularity in the torn edge, but it is insignificant in terms of the function of the invention.

In the interests of brevity and conciseness, any ranges of values set forth in this specification contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5".

It will be appreciated that the foregoing description and figures, given for purposes of illustration, are not to be construed as limiting the scope of this invention, which is defined by the following claims and all equivalents thereto.

We claim:

1. A product wrapped in a layered film comprising two outer layers of low density polyethylene and an inner layer of high density polyethylene, wherein the inner layer constitutes about 70 percent or more of the film on a weight percent basis the film having a molecular orientation direction, the film having a starter tab comprising a line of weakness defining a two-dimensional open-ended shape having a first side and an opposing second side, wherein the first and second sides of the starter tab are parallel or substantially parallel to the molecular orientation direction of the film.

2. The product of claim 1 wherein the film has a Tear Strength in the direction of molecular orientation of about 60 grams-force or less.

3. The product of claim 1 wherein the line of weakness of the starter tab is a line of perforations.

4. The product of claim 1 wherein the starter tab has an open-ended shape.

5. The product of claim 1 wherein the starter tab has a semi-circular shape.

6. The product of claim 1 wherein the starter tab has a width from about 0.25 to about 3 inches.

7. The product of claim 1 wherein the line of weakness defining the starter tab has a length from about 1 to about 6 inches.

8. A paper towel product comprising:

(a) a roll of paper toweling, said roll having two ends and a central axis;

(b) a polymeric film wrapper wrapped around the roll of paper toweling, thereby forming a package having two ends and a continuous sidewall therebetween, said polymeric film wrapper comprising a layered film comprising two outer layers of low density polyethylene and an inner layer of high density polyethylene, wherein the inner layer constitutes about 70 percent or more of the film on a weight percent basis and having a molecular orientation direction which is parallel or substantially parallel to the central axis of the roll; and (c) said package having a starter tab defined by a line of weakness in the sidewall of the package, whereby a user can grasp the wrapper by depressing the starter tab and breaking the line of weakness, and thereafter open the package by pulling the starter tab in the molecular orientation direction of the wrapper to cleanly tear the wrapper.

9. The product of claim 8 wherein the polymeric film wrapper has a Tear Strength in the direction of molecular orientation of about 60 grams-force or less.

10. The product of claim 8 wherein the line of weakness of the starter tab is a line of perforations.

11. The product of claim 8 wherein the starter tab has an open-ended shape.

12. The product of claim 8 wherein the starter tab has a semi-circular shape.

13. The product of claim 8 wherein the starter tab has a width from about 0.25 to about 3 inches.

14. The product of claim 8 wherein the line of weakness defining the starter tab has a length from about 1 to about 6 inches.

* * * * *